US006631906B1

(12) United States Patent
Timpano

(10) Patent No.: US 6,631,906 B1
(45) Date of Patent: Oct. 14, 2003

(54) SUPPLEMENTAL WAGER FOR PAI GOW POKER

(76) Inventor: Mike Timpano, 364 Grenville Ave., Orillia, Ontario (CA), L3V 7P7

( * ) Notice: Subject to any disclaimer, the term of this patent is extended or adjusted under 35 U.S.C. 154(b) by 0 days.

(21) Appl. No.: 09/946,641

(22) Filed: Sep. 4, 2001

(51) Int. Cl.[7] ..... A63F 1/00
(52) U.S. Cl. ..... 273/292; 273/274
(58) Field of Search ..... 273/292, 274; 463/12, 13

(56) References Cited

U.S. PATENT DOCUMENTS 5,863,041 A * 1/1999 Boylan et al. ..... 273/292
6,012,720 A * 1/2000 Webb ..... 273/292

* cited by examiner

*Primary Examiner*—Benjamin H. Layno
(74) *Attorney, Agent, or Firm*—Anderson & Morishita; Robert Ryan Morishita

(57) ABSTRACT

A method for providing a supplemental wager for a base game, such as Pai Gow Poker, in which a quantity of card are dealt to a banker and player and the dealt cards are arranged into at least two sub-hands. Each player places a supplemental wager. Should a preselected sub-hand of the player outranks the corresponding banker sub-hand, the player wins the supplemental wager. If, however, a preselected sub-hand of the banker outranks the corresponding sub-hand of the player, the player loses the supplemental wager. If the banker and player preselected sub-hands are tied, the tie is resolved in a pre-established fashion so that either the player or the banker wins.

3 Claims, 1 Drawing Sheet

SUPPLEMENTAL WAGER FOR PAI GOW POKER

FIELD OF THE INVENTION

The present invention relates to casino wagering games. Specifically, the present invention is a supplemental wager to a game in which a quantity of cards is separated into sub-hands, like Pai Gow Poker, to permit a resolution in games that may normally result in a push.

BACKGROUND OF THE INVENTION

Pai Gow is a gambling game originating in China that is played with a set of thirty two tiles. Each tile includes a number of pips indicating the rank of the tile. For reasons of tradition, a tile's rank of the tile is unrelated to the quantity of pips on the tile. For example, a tile with twelve pips is the highest ranking tile; a tile with three pips is the lowest ranking tile.

A game of Pai Gow begins with players making a wager. A hand consisting of four tiles is dealt to each player and a banker. The banker and each player organize their four tile hand into two sub-hands, a high hand and a low hand, with each sub-hand having two tiles. The low hand must have a lower ranking than the high hand according to the established rankings of Pai Gow tiles.

Wagers are resolved by comparing the Pai Gow rank of the player's high hand and low hand to the Pai Gow rank of the banker's high hand and low hand, respectively. If both the player's high and low hands outrank the banker's high and low hands, the player wins and is payed even money, less a five percent commission to the casino. If the banker's high and low hands outrank the player's high and low hands, the banker collects the player's wager. If one, but not both, of the player's hands outrank the one of the banker's hands, the game is a push and the wager is neither collected nor paid.

A major drawback of Pai Gow is that the rankings are complicated. As discussed above, the ranking of a tile is not directly related to the quantity of pips on the tile. Additionally, different combinations of tiles create different rankings. Thus, Pai Gow is a game that only experienced players can play quickly. To address this problem simplified games have been created, such as Pai Gow Poker, that use simpler or better known ranking systems, such as conventional poker rankings.

In Pai Gow Poker, players each make an ante wager and receive a seven card hand. Additionally, seven cards are dealt to a banker. The banker and players arrange the seven card hand into two sub-hands, a five-card high hand and a two-card low hand. The only requirement in forming the sub-hands is that the low hand must be of a lower rank than the high hand. The ranking of a sub-hand is the same as in traditional poker with the exception that, in one optional embodiment, the Joker may be used as an unrestricted or restricted wild card. For example, a Joker may be restricted to use only as an Ace or as a wild card to complete a straight or flush. Each player exposes his or her cards and resolves his or her wager by comparing his or her high hand to the banker's high hand and his or her low hand to the banker's low hand.

The player wins if both sub-hands outrank the corresponding banker's sub-hands according to conventional poker rankings. Winners are paid at even money. If one of the player's sub-hands outranks one of the banker's sub-hands, and the other banker's sub-hand ties or outranks the other player sub-hand, the player and banker "push" and the player neither wins nor loses his wager. If both the banker's sub-hands outrank or tie the player's sub-hands, the player loses his or her wager.

The result of this game structure is that approximately 41.5% of Pai Gow Poker hands result in a push. That is, in approximately 41.5% of Pai Gow Poker hands, there is no decision permitting the casino or player to win. Consequently, a casino deals a large number of Pai Gow Poker hands without any hold opportunity, i.e. an opportunity to collect a player's wager or collect a commission. Additionally, standard Pai Gow Poker is viewed by many players as a relatively slow game since many outcomes are not favorable or unfavorable to either the player or the dealer.

It can, therefore, be seen that there is a need in the art for a supplemental wager for a base game such as Pai Gow Poker that provides a resolution on every hand dealt in which the supplemental wager is placed.

SUMMARY OF THE INVENTION

The present method is a supplemental wager for a base game, like Pai Gow Poker, between a player and a banker. In the base game, each player places an ante wager and a quantity of cards are dealt to the banker and player. The banker and player arrange their cards into first and second sub-hands and the player's ante wager is resolved by comparing the player's sub-hands to the banker's corresponding sub-hands.

More specifically, if the base game is Pai Gow Poker, each player places an ante wager and seven cards are dealt to the banker and each player. The banker and each player arrange their seven cards into a two-card low hand and a five-card high hand.

The method of the present invention begins with the player making a supplemental wager along with his or her ante wager. It is contemplated that any of the sub-hands could be used in resolving the supplemental wager. Thus, it is predetermined which of the sub-hands will be used in resolving the supplemental wager and which of the player or banker will win the supplemental wager if the selected sub-hands are tied. For example, in the game of Pai Gow Poker, the two card hand, or low hand, could be used to resolve the supplemental wager and the banker could be designated to win all ties.

After the cards are dealt and arranged, each player's supplemental wager is resolved by comparing the selected one of the banker's sub-hands to the player's corresponding sub-hand. The player wins the supplemental wager and receives a reward if the player's sub-hand outranks the banker's corresponding sub-hand. Conversely, the player loses his or her supplemental wager to the banker if the banker's sub-hand outranks said player's corresponding sub-hand. Finally, if the sub-hands are tied, either the player or banker wins as predetermined.

Along with resolving the supplemental wagers, the ante wagers are also resolved. If both the player's sub-hands outrank the banker's sub-hands the player wins his ante wager. If the banker's sub-hands outrank or tie the player's corresponding sub-hands, the player loses the ante wager to the banker. If one of the player's sub-hands outranks the corresponding banker's sub-hand and the other of the banker's sub-hands outranks or ties the corresponding player's sub-hand, the result is a push and the player neither loses nor wins the ante wager.

Thus, in the example of Pai Gow Poker, in which the low hand is used to resolve the supplemental wager and the banker wins on ties, each player's supplemental wager is resolved by comparing the banker's low hand to the player's low hand. The player wins the supplemental wager and receives a reward if the player's low hand outranks the banker's low hand. The player loses his or her supplemental wager to the banker if the banker's low hand outranks or ties the player's low hand.

Again, along with the supplemental wagers, ante wagers are also resolved. Where the base game is Pai Gow Poker, ante wagers are resolved by comparing each player's low hand and high hand to the banker's low hand and high hand, respectively. If both the player's low hand and high hand outrank the banker's low hand and high hand, respectively, the player wins his or her ante wager. Conversely, if the banker's low hand and high hand outrank or tie the player's low hand and high hand, respectively, the player loses his or her ante wager. If one of the player's hands outranks the corresponding banker's hand and the other of the banker's hands outranks or ties the corresponding player's hand, the result is a push and the player neither wins nor loses his ante wager.

It is an object of the present invention to provide a supplemental wager for a base game, like that of Pai Gow Poker, which provides a resolution on every hand dealt in which the supplemental wager is placed.

DESCRIPTION

Figure 1:
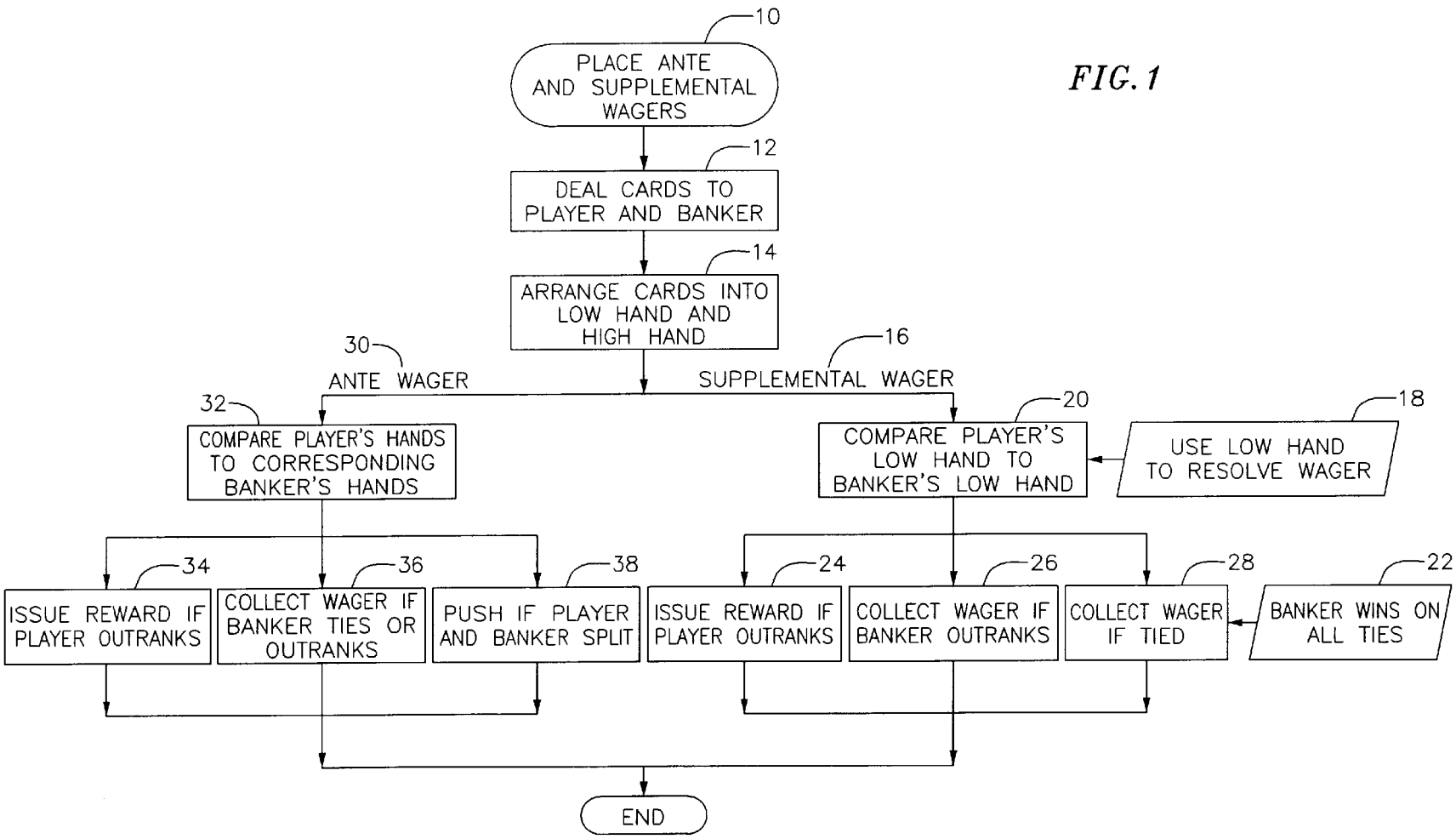
FIG. 1 is a flow chart of a game method according to an embodiment of the present invention.

Reference is now made to the figures wherein like parts are referred to by like numerals throughout. The supplemental wager of the present invention is directed to a base game, like Pai Gow Poker. Consequently, the supplemental wager may be placed using a conventional layout or a layout modified to include a wagering area specifically for the supplemental wager. For example, in an optional embodiment in which the base game is Pai Gow Poker, the layout may include a wagering area for the supplemental wager above the area where the cards may be arranged. Without regard to the layout used, the method of play is the same.

Referring to FIG. 1, play of the base game begins with the player or players making 10 an ante wager. According to the method of the present invention, a supplemental wager is also placed 10. In one form the present game, the supplemental wager may be optional. As may be appreciated, limits on the ante wager and supplemental wager may be set by the game operator or casino. The base game may be Pai Gow Poker or any variation on Pai Gow or Pai Gow Poker in which players are dealt a quantity of cards and the cards are arranged into two or more sub-hands. Thus, the embodiment based on Pai Gow Poker described below should be considered illustrative rather than limiting.

Once each player has placed 10 an ante wager and a supplemental wager, if so desired, a quantity of cards are dealt 12 to each player and the banker. As used herein, the banker may refer to a house dealer or, in an optional embodiment, a player who selects to assume the role of banker. Upon receiving the cards, each player and the banker arrange 14 their hand into at least two sub-hands according to the rules of the base game. Thus, in an embodiment based on Pai Gow Poker, the players and the banker are each dealt 12 seven cards. Each of the players and banker arranges 14 his or her seven card hand into a high hand consisting of five cards and a low hand consisting of two cards.

At some point prior to resolving the supplemental wagers, the sub-hand used to resolve the supplemental wagers must be established 18. Also, it must be determined 22 whether the player or banker will win if the sub-hands selected to resolve the supplemental wagers are tied. For example, it may be established that for a base game of Pai Gow Poker, the two-card low hand will be used 18 to resolve the supplemental wagers and that the banker will win on all ties 22. However, other embodiments using the high hand to resolve supplemental wagers and/or permitting the player to win on ties may be used are contemplated.

The supplemental wager and ante wager are resolved 16, 30. As alluded to above, supplemental wagers are resolved 16 by comparing 20 the selected sub-hands of each player and the banker. That is, the selected sub-hand of each player is compared 20 to the corresponding banker sub-hand. In the example of FIG. 1 in which Pai Gow Poker is the base game, each player's low hand is compared 20 to the banker's low hand. If the player's low hand outranks the banker's low hand, the player wins 24 his supplemental wager and is rewarded, optionally at even money. In a further optional embodiment, the player may be charged a commission, such as five percent, by the house on all winning wagers. In other words, in such an optional embodiment, supplemental wagers are rewarded at even money less the commission. Conversely, if the banker's low hand outranks the player's low hand, the player loses 26 his supplemental wager and the banker collects the player's supplemental wager.

If the banker's low hand and the player's low hand are tied, the tie is resolved 28 as preselected. In other words, if it is determined that the banker will win on all ties, the player loses his supplemental wager if his or her low hand is equal in rank to the banker's low hand. Conversely, if it is determined that the player will win on all ties, the player will win his supplemental wager and receive a reward if his or her low hand is equal in rank to the banker's low hand. In the example of FIG. 1, the banker wins 22 all ties. Thus, in this optional embodiment, the player loses 28 his or her supplemental wager if the banker's low hand outranks or ties the player's low hand.

Ante wagers are also resolved 30 in a manner consistent with the base game. In the base game, the player wins 34 the ante wager if both the player's sub-hands outrank the banker's corresponding sub-hands. Conversely, the player loses 36 the ante wager if both the banker's sub-hands outrank or tie the player's corresponding sub-hands. A push is declared 38 if one of the player's sub-hands outranks the corresponding banker sub-hand and the other banker hand outranks or ties the player's corresponding sub-hand.

Thus, in the example of Pai Gow Poker, the player wins 34 the ante wager if the player's low and high hands outrank the banker's low and high hands, respectively. The player loses 36 the ante wager if the banker's low and high hands outrank the player's low and high hands, respectively. The player pushes 38, and neither wins nor loses the ante wager, if one of the player's hands outranks the corresponding banker hand and the remaining banker hand outranks or ties the corresponding player hand.

While certain embodiments of the present invention have been shown and described it is to be understood that the present invention is subject to many modifications and changes without departing from the spirit and scope of the claims presented herein.

I claim:

1. A method for providing a supplemental wager for a base game between a player and a banker in which each player places an ante wager, a quantity of cards are dealt to the banker and player, the banker and player arrange their cards into first and second sub-hands, and the player's ante wager is resolved by comparing the player's sub-hands to the banker's corresponding sub-hands, the player winning the ante wager if both the player's sub-hands outrank the banker's sub-hands, the player losing the ante wager to the banker if the banker's sub-hands outrank or tie the player's corresponding sub-hands, and a push being declared and the player neither losing nor winning the ante wager if one of the player's, sub-hands outranks the corresponding banker's sub-hand and the other of the banker's sub-hands outranks or ties the corresponding player's sub-hand, comprising:

the player making a supplemental wager;

prior to dealing said cards, designating either said first or second sub-hands for resolution of a supplemental wager and designating either the player or the banker to win said supplemental wager if said designated sub-hands are tied; and resolving each player's supplemental wager by comparing only the designated one of the banker's sub-hands to the player's corresponding sub-hand, said player winning said supplemental wager and receiving a reward if said player's designated sub-hand outranks the banker's corresponding designated sub-hand and said player losing said supplemental wager to the banker if said banker's designated sub-hand outranks said player's corresponding designated sub-hand, and if said sub-hands are tied, either the player or banker winning as selected.

2. A method for providing a.supplemental wager for a base game between a player and a banker in which each player places an ante wager, a quantity of cards are dealt to the banker and player, the banker and player arrange their cards into two sub-hands, a high hand and a low hand, and the player's ante wager is resolved by comparing the player's sub-hands to the banker's corresponding sub-hands, the player winning the ante wager if both the player's sub-hands outrank the banker's sub-hands, the player losing the ante wager to the banker if the banker's sub-hands outrank or tie the player's corresponding sub-hands, and a push being declared and the player neither losing nor winning the ante wager if one of the player's sub-hands outranks the corresponding banker's sub-hand and the other of the banker's sub-hands outranks or ties the corresponding player's sub-hand, comprising:

the player making a supplemental wager; and resolving each player's supplemental wager by comparing only the banker's low hand to the player's low hand, said player winning said supplemental wager and receiving a reward if said player's low hand outranks the banker's low hand and said player losing said supplemental wager to the banker if said banker's low hand outranks or ties said player's low hand.

3. A method of playing a game of chance between a banker and at least one player comprising:

each player placing an ante wager and a supplemental wager;

dealing seven cards to the banker and each player;

the banker and each player arranging their cards into a two-card low hand and a five-card high hand;

resolving each player's supplemental wager by comparing only the banker's low hand to the player's low hand, said player winning said supplemental wager and receiving a reward if said player's low hand outranks the banker's low hand and said player losing said supplemental wager to the banker if said banker's low hand outranks or ties said player's low hand; and resolving each player's ante wager by comparing a low hand of said player to said low hand of said banker and a high hand of said player to said high hand of said banker, said player winning said ante wager if both the player's low hand and high hand outrank the banker's low hand and high hand, respectively, said player losing said ante wager to the banker if said banker's low hand and high hand outrank or tie the player's low hand and high hand, respectively, and a push being declared and the player neither losing nor winning said ante wager if one of the player's hands outranks the corresponding banker's hand and the other of the banker's hands outranks or ties the corresponding player's hand.

* * * * *